United States Patent [19]

Forward et al.

[11] 4,146,323

[45] Mar. 27, 1979

[54] AUGER FOR A DEVELOPMENT SYSTEM

[75] Inventors: John E. Forward, Penfield; Raymond C. Coleman, Webster, both of N.Y.

[73] Assignee: Xerox Corporation, Stamford, Conn.

[21] Appl. No.: 811,015

[22] Filed: Jun. 29, 1977

[51] Int. Cl.[2] ..... G03G 15/06; G03G 15/09

[52] U.S. Cl. ..... 355/3 DD; 118/657; 366/324

[58] Field of Search ..... 355/3 R, 3 DD; 118/653, 118/657, 658; 366/320, 324

[56] References Cited

U.S. PATENT DOCUMENTS

| | | | |
|---|---|---|---|
| 986,553 | 3/1911 | Derby | 366/324 X |
| 3,102,004 | 8/1963 | Grintz | 366/324 X |
| 3,542,466 | 11/1970 | Fox et al. | 355/3 DD |
| 3,639,051 | 2/1972 | Charlap et al. | 355/3 DD |
| 4,056,076 | 11/1977 | Smith | 118/658 X |

FOREIGN PATENT DOCUMENTS

| | | | |
|---|---|---|---|
| 515128 | 11/1952 | Belgium | 366/324 |
| 497522 | 9/1919 | France | 366/324 |
| 20758 | 12/1972 | Japan | 355/3 DD |

*Primary Examiner*—Fred L. Braun

[57] ABSTRACT

An auger for use in a xerographic development system comprising an elongated twisted unitary strip of sheet metal, defined by two helically contoured edges extending along the longitudinal axis of the auger. The auger contains a series of spaced apart slots or recesses along the outer periphery of the helical edges, the slots extending inwardly a short distance from the edges toward the axis of the auger.

2 Claims, 3 Drawing Figures

AUGER FOR A DEVELOPMENT SYSTEM

BACKGROUND OF THE INVENTION

This application is directed to an improved auger mixing device for use in a xerographic development system of the type disclosed in U.S. Pat. No. 3,947,107.

In the aforementioned patent there is disclosed a development system for a xerographic machine which incorporates a mixing arrangement for maintaining a more or less uniform distribution of toner throughout the supply of developer so that the developer may be circulated numerous times through the system without a marked reduction in the quality of the copies produced. The mixing arrangement comprises an active crossmixer including a pair of rotatably driven augers and a baffle for partially submerging the augers in developer. The mixing arrangement is mounted in the development system of an electrostatic processor above the sump in a position to intercept both the developer returning from the development zone and any additional toner added to the system to maintain the toner concentration at a suitably high level. The developer is divided between the augers which, in turn, laterally transport the developer in opposite directions. Preferably, the baffle is apertured so that developer not only flows over the ends of the baffle but also through the baffle, thereby distributing the developer across the full width of the sump.

SUMMARY OF THE INVENTION

This invention proposes a new type of auger for use in xerographic development systems of the type disclosed in the aforementioned patent. The auger comprises an elongated twisted unitary strip of sheet metal, defined by two helically contoured edges extending along the length of the auger. The auger contains a series of spaced apart slots or recesses along the outer periphery of the helical edges, the slots extending inwardly a short distance from the edges toward the axis of the auger.

BRIEF DESCRIPTION OF THE DRAWINGS

The invention will be more clearly understood when the following detailed description is read in conjunction with the attached drawings, in which.

DETAILED DESCRIPTION OF THE PREFERRED EMBODIMENT

The invention will be described as being incorporated into the development system of U.S. Pat. No. 3,947,107 and the disclosure thereof is hereby incorporated by reference. It is to be understood, however, that there is no intention to limit the invention to that embodiment but on the contrary the intent is to cover all modifications, alternatives and equivalents falling within the spirit and scope of the appended claims.

Turning now to the drawings, it will be seen that the invention is embodied in a development system 11 which is used in an electrostatic processor to develop latent electrostatic images carried by a photoconductor 13, as the photoconductor 13 moves through a development zone 14. The details of the processor may be seen more particularly in the aforementioned patent and also U.S. Pat. No. 3,724,019.

Figure 1:
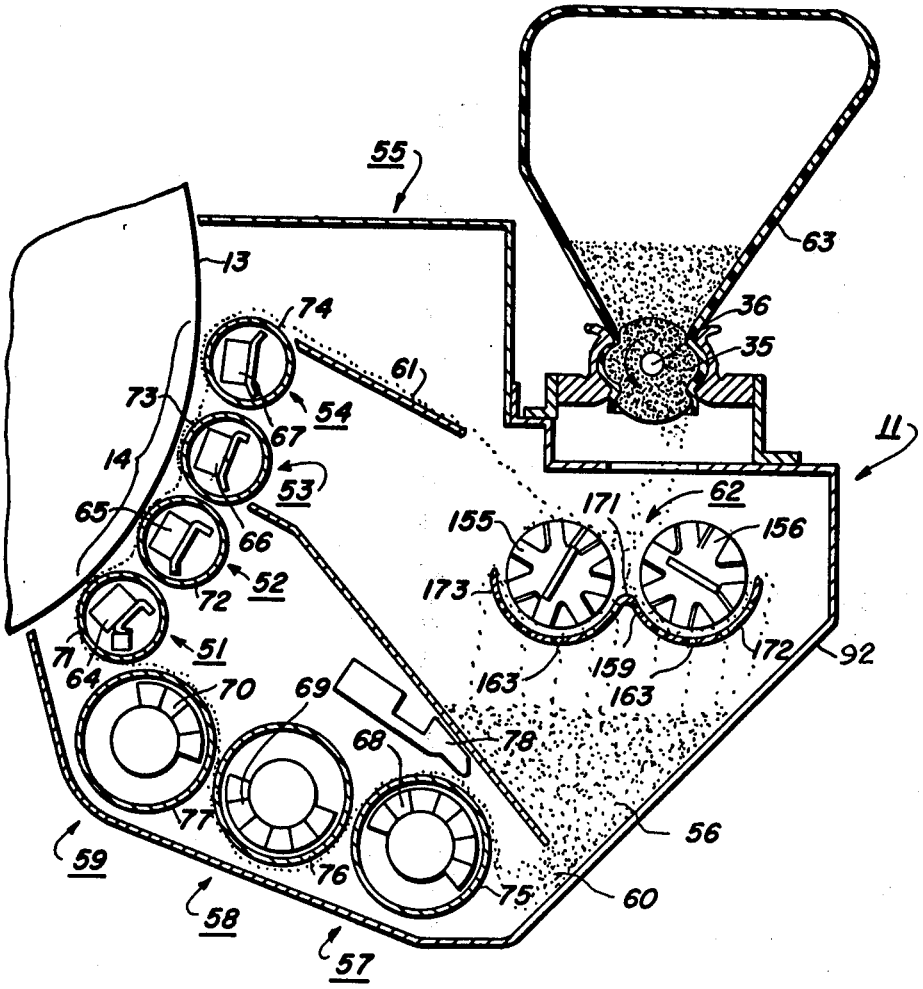
FIG. 1 is an illustrative sectional view illustrating the basic components of the development system of the type in which the auger of the invention is incorporated.

The development system 11 applies toner to develop the electrostatic image carried by the photoconductor 13 as it advances through the development zone 14. As shown in FIG. 1, the development system 11 is a so-called "magnetic brush" unit having a series of four development rolls 51–54 positioned in parallel spaced apart relationship along the length of the development zone 14 for bringing developer into contact with the photoconductor 13. The development rolls 51–54 are mounted in a housing 55 which comprises a sump 56 for storing a supply of developer, a series of three magnetic transport rolls 57–59 for transporting developer from the sump 56 to the first or lowermost development roll 51, and a slide 61 for guiding developer from the last or uppermost development roll 54 to a crossmixer 62. As explained more fully hereinbelow, the crossmixer 62 conditions the incoming developer for recirculation and then returns it to the sump 56. Some toner is, of course, removed from the developer each time an image is developed. Thus, there is a toner dispenser 63 mounted on the housing 55 in a position directly above the crossmixer 62 for adding fresh toner to the developer from time-to-time so that its toner concentration remains at a suitably high level.

This type of development system is conventionally supplied with a multi-component developer comprising finely divided, resinous toner particles and relatively coarse, ferromagnetic carrier particles. The materials for the toner and carrier (or sometimes carrier coating) are removed from one another in the triboelectric series so that a triboelectric charging process may be relied upon to induce electrical charges of opposite polarities on the toner and carrier particles. Moreover, the materials are selected so that the charge imparted to the toner particles opposes the charge of the latent images which are to be developed. Therefore, in operation, there are competing electrostatic forces acting on the toner particles, whereby those particles are at least initially attracted to the carrier particles, but are subject to being electrostatically stripped therefrom whenever the developer is brought into the immediate proximity of or actual contact with the photoconductor 13.

As best shown in FIG. 1 developer flowing through an opening 60 near the bottom of the sump 56 is transported along a generally S-shaped path by the transport rolls 57–59 and is then fed upwardly between the photoconductor 13 and successive ones of the development rolls 51–54. The developer within this part of the system is magnetically constrained. Specifically, the development rolls 51–54 and the transport rolls 57–60 comprise permanent magnet assemblies 64–70, respectively, which are supported within separate non-magnetic, cylindrical sleeves 71–77 which, in turn, are rotatably driven in the direction indicated by the arrows so that the developer advances from roll-to-roll as previously described.

Characteristically, the fields provided by the magnetic assemblies 64–67 of the development rolls 51–54 are shaped so that the developer tends to collimate as it passes between those rolls and the photoconductor 13, thereby forming bristle-like stacks of developer which brush against the photoconductor 13. To ensure that the "magnetic brushes" thus formed have a more or less uniform profile across the width of the development zone 14, there is in this instance a trimmer bar 78 secured to the outer surface of the forward sidewall 79 of the sump 56 for leveling the developer magnetically entrained on the first transport roll 57.

It is to be noted that the crossmixer 62 is a partially submerged, active crossmixing device which is mounted above the sump 56 in position to intercept not only the developer returning from the development zone 14 via the slide 61, but also any additional toner supplied by the toner dispenser 63. Among the reasons that the crossmixer 62 is especially noteworthy are that it requires relatively little power but still provides effective crossmixing and blending by virtue of being only partially submerged in a continuously changing, locally confined supply of developer. The temporary, local confinement of the developer is a particularly important concept because it reduces the risk of developer bypassing the crossmixing process.

More particularly, as shown, the crossmixer 62 comprises a pair of augers 155 and 156 of a construction to be described in detail hereinafter. The augers are supported in generally parallel, spaced apart relationship above a baffle 159 which has a central flow splitting surface 171 disposed between a pair of generally U-shaped channels 172 and 173. The augers 155 and 156 and the baffle 159 extend across substantially the full width of the movable section 92 of the housing 55, but are slightly spaced from the sides thereof. The channels 172 and 173 of the baffle 159 partially cup the augers 155 and 156, respectively, but are spaced a short distance therefrom. The flow splitting surface 171 of the baffle 159 is, in turn, virtually aligned with the toner dispenser 63 and roughly in the middle of the flow path for developer from the slide 61 so that it divides the developer and fresh toner more or less evenly between the channels 172 and 173. Preferably, there are several small apertures 163 passing through the channels 172 and 173 at spaced apart points along the length thereof to aid in maintaining a more or less even level of developer within the sump 56.

In operation, the augers 155 and 156 are rotated to laterally translate the developer toner loads of the channels 172 and 173 in opposite directions. To this end, the augers 155 and 156 may have the same hand and be counter-rotated by means of a pair of gears 161 which are coupled to a drive gear 97 turned by a suitable motive means 98. The gears 161 have shafts 163 which are supported for rotation in one wall of the housing, the other ends of the shafts having caps (not shown) for receiving the ends of each of the augers. The other ends of the augers are similarly reserved in caps supported for rotation in the walls of the housing. The same result could, however, be achieved by rotating the augers in the same direction if one was constructed to have a right-hand lead and the other a left-hand lead. In either event, the developer-toner mixture entering one or the other of the channels 172 and 173 dwells therein under the direct influence of the auger 155 or 156 until it finds its way out through one of the apertures 163 or over the outboard edges of the baffle 159. In practice, of course, the incoming and outgoing flows to and from the crossmixer 62 tend to balance.

The augers or baffle may, if desired, be made of a conductive material and electrically grounded whereby excessive charge is drained from the carrier particles while the developer is being mixed and blended. In addition, the augers or baffle may be coated with a material selected to augment the triboelectric charging of the toner particles or with a release agent selected to inhibit toner from adhering thereto. Furthermore, the augers or baffle may have a roughened surface finish whereby developer is mechanically abraded while being mixed and blended, thereby inhibiting the toner particles from mechanically impacting on the carrier particles.

The augers 155 and 156 are constructed in a manner described in detail in copending, commonly assigned application Serial No. 811,014 filed on June 29, 1977. and the details of that application are incorporated hereinto by reference.

Figure 2:
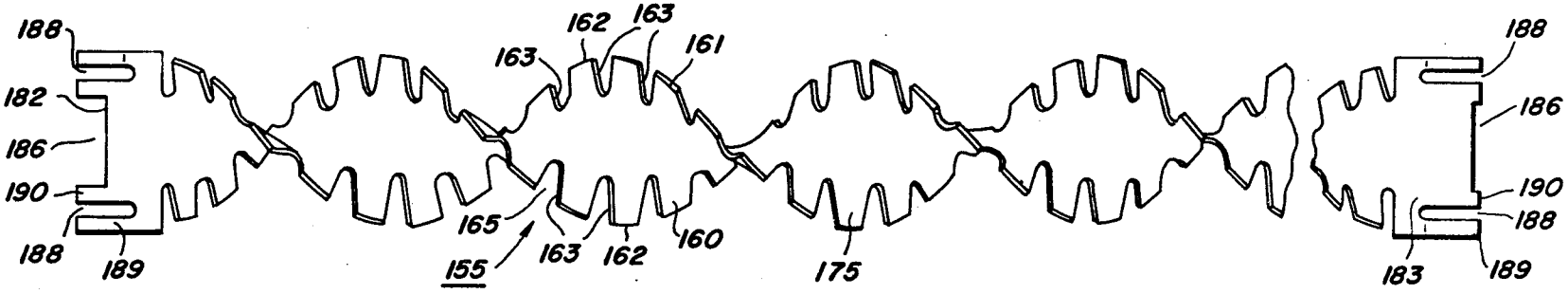
FIG. 2 is an elevation view of the auger of the invention.
Figure 3:
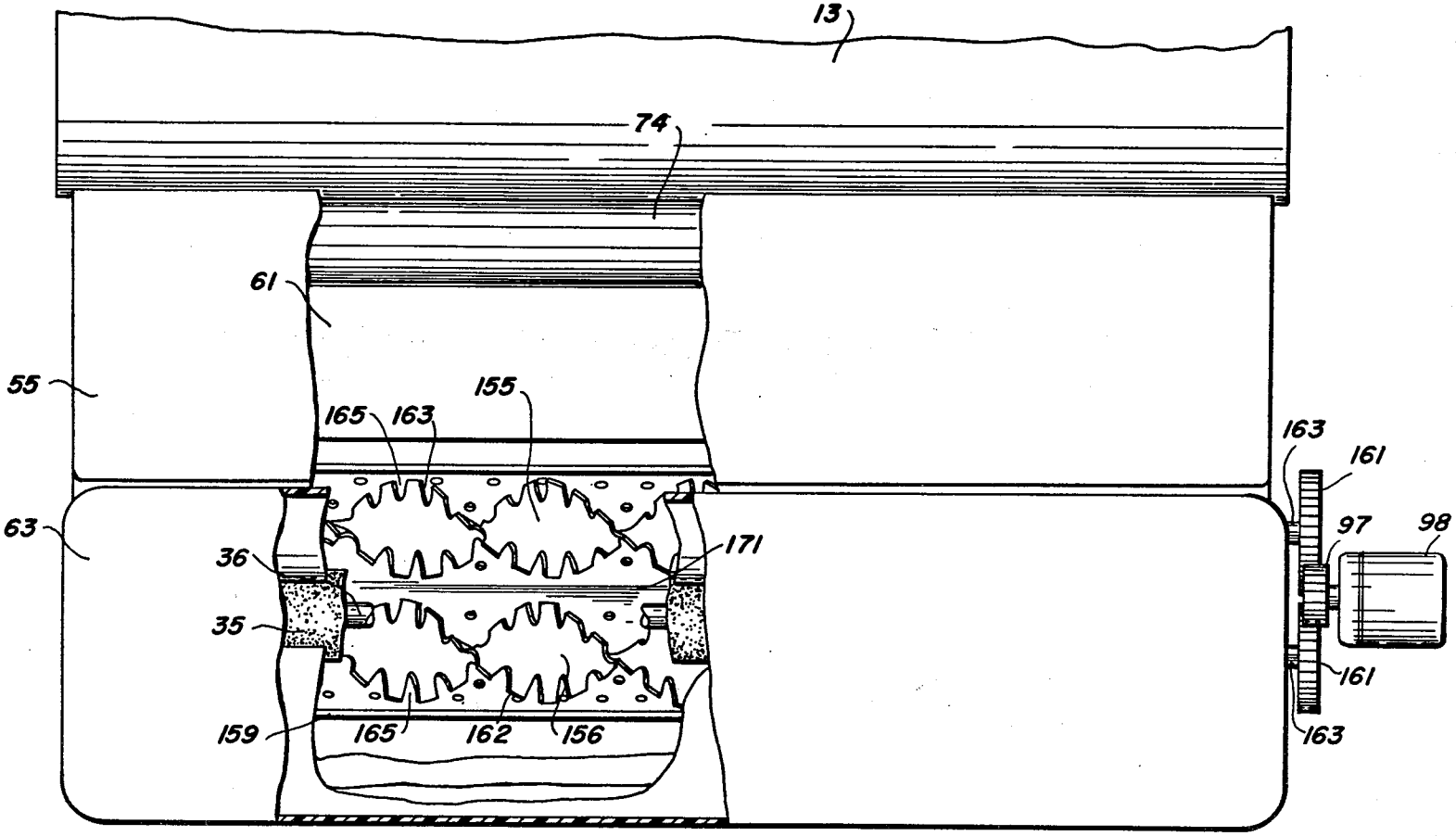
FIG. 3 is a plan view of augers of the invention incorporated into the development system of FIG. 1.

The auger 155 (and 156, since they are identical in construction), FIG. 2, comprises a unitary twisted piece of sheet metal and is defined by two contoured opposed edges 160 and 161 which run the length of the auger. The edges 160 and 161 are characterized by peripheral segments 162 separated from each other by arcuate segments 163, the latter defining a series of slots or voids 165, down the length of the auger. The peripheral segments 162 are approximate straight line elements variably angulated so as to trace an approximate helix, if connected by an imaginary line.

The slots 165 are approximately V-shaped and extend inwardly a short distance, the distance being selected so as to relieve the stresses in the material during the forming process, as described in greater detail in the aforementioned application. Adjacent slots 165 are separated by flutes which project outwardly to serve as mixing and moving fingers for the developer material. The corners of the flutes may be rounded (not shown) in order to prevent excessive working of the developer material.

The front and rear ends of the auger 155 are formed into planar sections 182 and 183 which serve to mount the auger for rotation by a drive mechanism. The sections 182 and 183 are similar in shape and are provided with suitable recesses 186 to interfit into the receiving caps of drive mechanism as noted hereinbefore. In a similar fashion slots 188 are provided in the front and rear sections. The slots 188 are defined by outer and inner wall portions 189 and 190 which are bent with respect to the plane of the sections 182 and 183 to continue the contour of the helices formed by the opposed side edges to a point immediately adjacent the drive bearings. This latter feature insures a mixing and moving action up to the walls of the developer housing.

It will be understood that various changes in the details, materials, steps and arrangements of parts which have been herein described and illustrated in order to explain the nature of the invention may be made by those skilled in the art within the principle and scope of this invention. It is therefore intended that this invention be interpreted to cover such modifications and changes as may come within the scope of the following claims.

What I claim is:

1. In a xerographic system including means for depositing developer material on an imaging surface having an electrostatic latent image thereon, an improved auger for mixing said developer material comprising a unitary twisted piece of sheet metal having two outer edges, each edge defined by series of peripheral segments separated from each other by arcuate segments, said peripheral segments approximating straight line elements variably angulated to trace a generally helical path along the periphery of said auger and said arcuate segments forming approximately V-shaped slots.

2. The system as defined in claim 1 wherein said auger has front and rear planar sections adapted to be rotated by a drive mechanism.

* * * * *